United States Patent [19]

Sendzimir

[11] 4,295,355

[45] Oct. 20, 1981

[54] BEAM-BACKED STRIP MILL WITH ATTACHED INSERTS

[76] Inventor: Tadeusz Sendzimir, P.O. Box 1350, Waterbury, Conn. 06720

[21] Appl. No.: 66,019

[22] Filed: Aug. 13, 1979

[51] Int. Cl.[3] ..... B21B 13/14

[52] U.S. Cl. ..... 72/242

[58] Field of Search ..... 72/241-243, 72/238, 237

[56] References Cited

U.S. PATENT DOCUMENTS 3,169,423 2/1965 Sims ..... 72/242

3,355,924 12/1967 Sendzimir ..... 72/241

*Primary Examiner*—Milton S. Mehr

*Attorney, Agent, or Firm*—Frost & Jacobs

[57] ABSTRACT

There is disclosed a multi-roll beam-backed mill for cold-rolling wide strips, where small diameter work-rolls are supported by other rolls and finally by casters whose supporting saddles are located in channels provided in arcuate-section segments affixed to inner cavities of said beams, said cavities forming jointly a cylindrical surface. Said arcuate segments may be removed and replaced by other arcuate segments to provide various roll configurations.

13 Claims, 10 Drawing Figures

BEAM-BACKED STRIP MILL WITH ATTACHED INSERTS

BACKGROUND OF THE INVENTION

The present invention is an improvement over the known 20-roll mill such as is disclosed, among others, in U.S. Pat. No. 2,776,586, FIGS. 1 and 10, hereinafter referred to as ZR Mills, which show a mill with a one-piece housing whose rigid beams each have arcuate channels parallel with the rolls, provided to accommodate spaced "saddles" which carry the roll-backing casters.

Mills built according to that disclosure have amply proven themselves in providing a rigid and precise support for small diameter workrolls—a support unobtainable by other type mills, especially for wide strips and for rolling hard to reduce metals such as stainless and spring steels.

But such mills are confined to a rigid geometry which only allows about 10% for roll wear and a small leeway in workroll diameter. And yet it is highly desirable for investments of this magnitude to provide for some versatility, e.g. a mill that can roll with equal efficiency a 0.030"×50" stainless steel strip, or a 0.040×50" low-carbon autobody sheet with equal ease. This requires a workroll diameter about three times greater. That problem was solved by U.S. Pat. No. 3,147,648 in which the workrolls and all their supporting elements were built into one cylindrical body, the "cartridge", which was pushed into the central opening in the one-piece housing for ultimate support by the rigid beams. The cartridges could be built to any geometry from the smallest rolls for hard steels down to medium and large diameter rolls for soft aluminum or even skinpassing. Yet this mill was too expensive to be accepted. The cost of a cartridge was close to ¼ of the cost of the mill and at least three were needed as spares for each roll configuration to insure steady production.

Applicant has developed a solution where the mill housing has only one central opening as in the said "cartridge" mill, while various geometry "inserts" are affixed to it. All other expensive elements for supporting the rolls, substantially like those of the ZR Mills can be used interchangeably in conjunction with any rolls.

DETAILED DESCRIPTION

Figure 1:
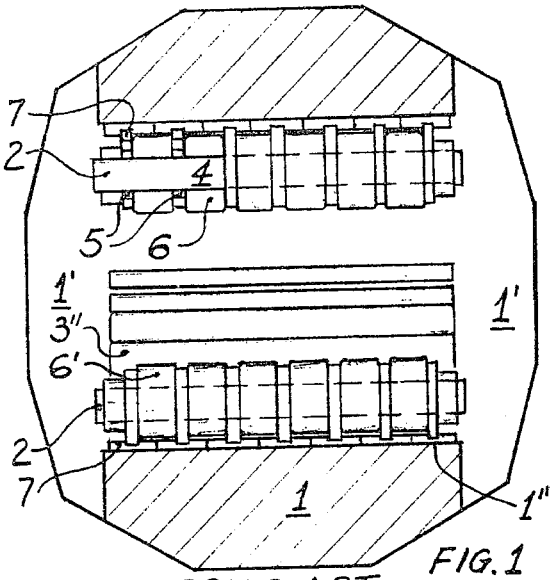
FIG. 1 PRIOR ART
FIG. 1 is a view partly in vertical section and partly in elevation of the ZR Mill.
Figure 2:
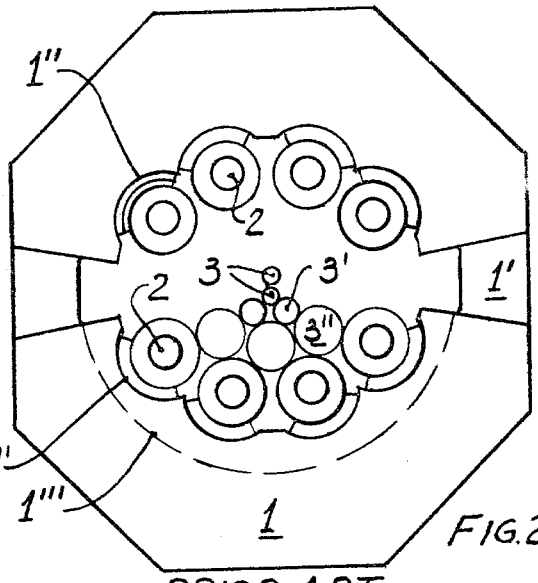
FIG. 2 PRIOR ART
FIG. 2 is a schematic cross section through the rolls and their supporting elements surrounded by the housing of the mill of FIG. 1.

FIGS. 1 and 2 illustrate the principle of the ZR Mill, which is composed of upper and lower beam-plates 1 connected at their edges by four columns 1'. Four arcuate-section channels 1" are provided in each beam to rigidly support the backing (supporting) elements 2 which prevent deflection of the workrolls 3 and the intermediate rolls 3' and 3" under rolling pressure. One complete backing assembly 2 is shown in cross section in the top part, and in elevation in the bottom part of FIG. 1. It consists of a shaft 4 with keyed screwdown eccentrics 5 alternating with backing casters 6 which contact the biggest intermediate rolls 3". Saddles 7 surround each eccentric 5 and are attached by clamping means to the arcuate hollow of the housing channel 1".

U.S. Pat. No. 3,147,648 discussed above modified that design only in that, instead of the four channels 1" provided in each housing beam, there is one single cylindrical bore partly penetrating both beams. Such bore is shown by a dotted line 1''' in FIG. 2. Special cartridges comprising their own backing elements are inserted into that cylindrical central bore.

Figure 3:
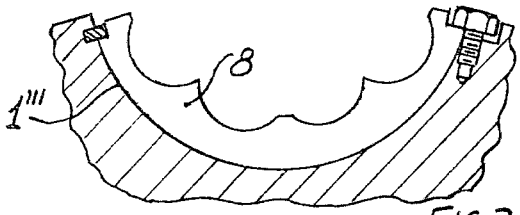
FIG. 3 is a partial section through the mill housing with a first embodiment of the invention clamped therein.

In contradistinction, applicant has developed housing inserts 8 shown in cross section of FIG. 3 which are solidly clamped or otherwise fastened onto the central bore 1''' and have on their inside arcuate channels. Regular backing saddles 7, like in the prior art ZR mill described above, are secured in the arcuate channels. Removal of these saddles for maintenance is accomplished in the same manner as is the practice with those mills. But if and when it is necessary to use rolls of diameters beyond the narrow range permissible with the regular mills, the inserts 8 can be removed quickly and relaced by others with different center distances of the channels required for such mill geometry.

It is well known that work-hardening materials such as high-carbon steels or stainless steels, when rolled to light gauges, are rolled most advantageously with as small workrolls as the mill will permit. But if softer metals are to be rolled, or even the tough materials are rolled to medium gauges, larger, sometimes much larger, roll diameters are desirable because (1) heavier passes can be taken, thereby increasing mill production and (2) too small workrolls have a tendency to produce a wavy strip because they penetrate the soft metal too easily. A two inch diameter workroll may be excellent for rolling 0.030" thick by 60" wide stainless strip; but for rolling low carbon steel of same width but say, 0.050" thick, 6" diameter workrolls are very much better, taking heavier passes and giving a flatter strip. Whereas a "regular" ZR Mill, as described above, has fixed center distances which admit work rolls from 1.8 to 2.3" diameter, the use of inserts according to the present invention makes it possible for one mill to cover the whole field of strip rolling with only a small expense for the inserts themselves, because all the backing elements are separate and can be used in conjunction with any inserts.

Figure 4:
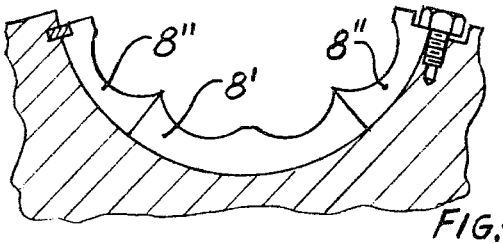
FIG. 4 is the same with a second embodiment similarly fastened.
Figure 5:
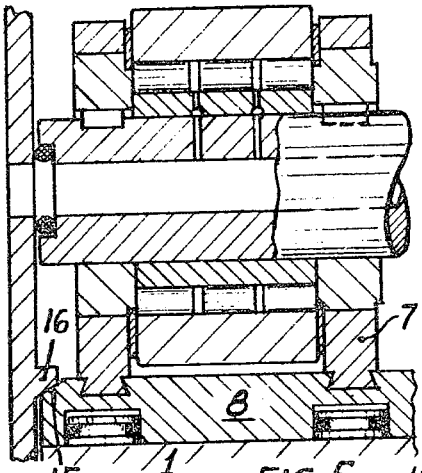
FIG. 5 is a partial section longitudinally through the housing of the second embodiment, including alternate means of attachment, and the final roll backing element.

The application of this principle can be further improved by dividing each insert in two or three segments. This is shown in FIG. 4 where the central segment has two channels and the two side segments have one each. First, some changes can be obtained by changing only one segment, e.g. for asymmetrical roll configurations in one-way mills, or two segments, second, they are easier to handle, third, they can be secured in position as shown in FIG. 5, by providing them with tapered ends 15 that engage a conical protrusion 16 in the back plate. Individual clamps tightened at the front end insure solid positioning. With such split inserts at least one side of the saddles is at the edge of the segment and so it is easier to secure the saddles to the segment first and then mount each whole assembly in the bore of the housing using the above front and rear end clamping device.

Figure 6:
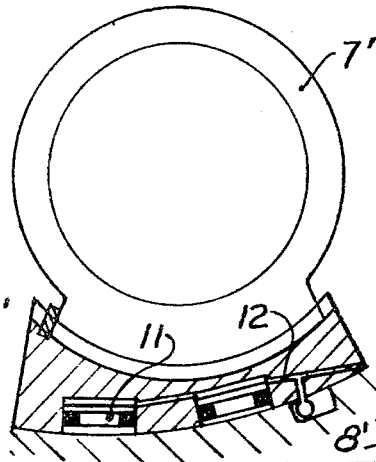
FIG. 6 is a section through the insert of the second embodiment with a modified "saddle" in place, and pressure-control means for same.
Figure 7:
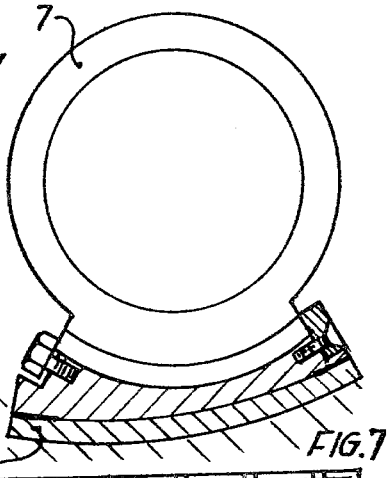
FIG. 7 shows the same with another type of pressure-control element.

Alternatively, FIGS. 5, 6 and 7 show simplified saddles 7' provided with a dovetail-section foot that is slid directly into suitable dovetail slots machined in said segment for secure and precise positioning of the saddles.

FIGS. 5, 6 and 7 show yet another feature that can be provided in the inserts, but which can be used with more precision with split inserts, and that is, individual pressure means on the outside faces of the insert segments, where they face the bore of the housing (or, optionally, in the housing) to bear controllable pressure tending to separate the two, and thus influence the pressure transmitted by one saddle compared with the others. This is easily the most important technical gain brought about by the introduction of these inserts, because it solves the problem of producing flat sheets much more simply and economically than conventional means involving double eccentrics. Such double eccentrics are very delicate and for this reason are only used in large size mills.

Hydraulic pressure discs 11 (like flat pistons) inserted in cavities provided on the outside face of the insert and suitably sealed, as by O-rings, are fed by fluid under pressure introduced through holes 12 in the insert and connected to a controllable outside pressure source. I prefer to employ a cluster of say, four small flat pistons for each saddle but a single large one is also acceptable. The pressure is instantly controllable, either manually by the operator, or automatically from a signal of a flatness gauge by any one of known systems. Wherever a wavy edge or a buckled center of the strip begins to appear, it is an indication that the workrolls are exerting too much pressure and are over-rolling the metal in that area. This device corrects the error instantly. Correction may be obtained by having only one insert so equipped but it is preferable to equip two or even all four inserts because a smaller correction is needed in such case and also becuase one single hydraulic control system takes care of the whole thing. It must be understood that we are dealing with minute elastic deflections only. Even an increase in pressure of one saddle by as much as 20% will not cause that saddle to be lifted off its seat, only the pressure upon the rest of the area will diminish.

FIG. 7 shows a different embodiment of such control. The border of plate 8' is permanently attached to the outside face of insert 8 preferably by such means as brazing or welding, to separate a roughly rectangular area corresponding to the foot of the saddle (or, in case of narrow-foot saddles of FIG. 7, extending almost half-way in both directions, toward the neighboring saddles). The outside face of the insert is thus divided into rectangular pockets hermetically sealed against the outside and against each other. Access of pressurized fluid is provided preferably through holes drilled in said insert 8. This embodiment exposes larger areas to fluid pressure, which means that lower specific pressures are sufficient. Besides, since there are no sliding parts, no seals are reuired.

Figure 10:
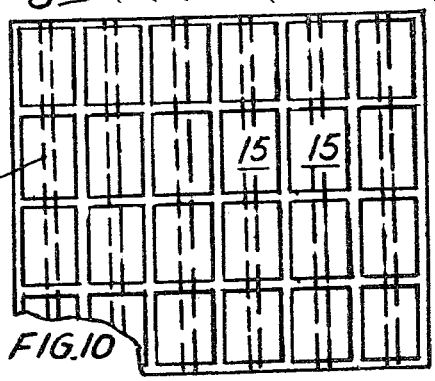
FIG. 10 is a schematic view of the face of the "insert" contacting the housing and the distribution of pressure controlling areas.

FIG. 10 shows schematically the developed view of such an insert from the housing side, with the plate 8' removed. The dotted lines 14 show the position and the width of the saddles, the rectangles 15 represent the areas of the fluid pressure, and the stripes between them are areas where brazing or equivalent means of attaching and sealing are applied.

While such structure whether extending over one row of saddles or more, may be used for flatness control of the strip as explaind above, it is also suitable for an ultra-fast response automatic gauge control. A fluid control envelope pattern as shown in FIG. 10, or a similar pattern but covering only the two central rows of saddles can be used to transmit signals from thickness gauges in an almost inertia-free static manner to correct errors. In this case, all envelopes are connected in parallel to the fluid pressure control valve so as to obtain an even pressure control of all saddles so connected. When beginning a pass, correct gauge is first obtained with the use of the regular screwdown which is then left alone for the rest of the pass, while this pressure control takes over. Initial pressure must first be set half-way between the lowest and highest and from there on, it will increase or decrease roll pressure to maintain even gauge within a thickness range of about one to two thousandths of an inch which is adequate, since corrections are hardly ever more than one ten-thousandth of an inch.

This gauge control is of course distant and apart from the previously described flatness control and I prefer to have the gauge control installed in the top insert to control pressure on the upper workroll and the other in the bottom insert, to control distribution of pressure across the face of the bottom workroll.

In either control system, whenever neighboring envelopes are to have the same pressure, the brazed sealing stripes 13 disposed between them can be omitted.

Another feature of the invention is that even existing ZR Mills such as disclosed in U.S. Pat. No. 2,479,974 above can benefit by the subject invention after the mill housing has been rebored. When the wear of the eight bores contacting the backing assemblies begins to affect the mill's accuracy, the mill housing must be moved to a machine shop for reboring. This is not so if the eight bores have to be replaced by one central cylindrical bore to fit the inserts according to the present invention. Advantage is taken of the fact that the eight bores are only worn where they were contacted by the backing assemblies but there is no wear on the last two or three inches near the edge. A portable boring fixture is firmly clamped, preferably, to the two top and two bottom channels both at the front and the rear end of the housing, and the tool-carrying spindle in centered and set, parallel with the original bores using the surfaces of those bores as reference and as bases. Thus the conversion can be accomplished, restoring the mill to its original accuracy and at a minimal cost and without moving it. But the economic implications go considerably beyond this saving: (1) the mill can continue to use the inventory of all backing assemblies, intermediate rolls and workrolls and (2) a set of special inserts can be provided, dimensioned to accept all undersize rolls and give the whole stock of rolls discarded because of too small diameter, a new lease on life.

Figure 8:
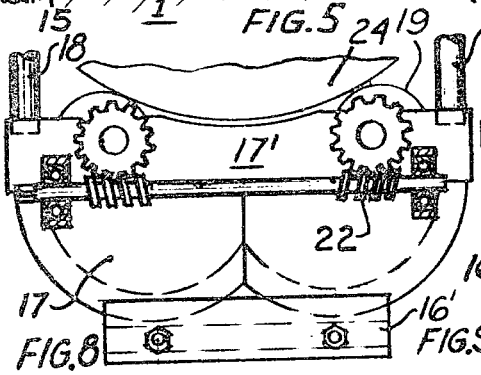
FIG. 8 shows a side elevation and FIG. 9 a cross section of an auxiliary apparatus useful in converting existing mills to the use of the invention.
Figure 9:
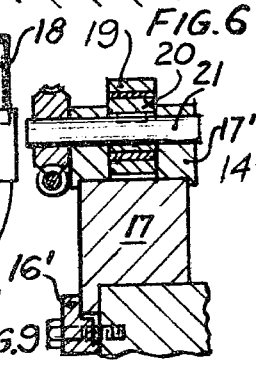

FIGS. 8 and 9 show the manner how the mounting of a boring spindle for such operation can be accomplished. Four semi-circular flanged blocks 17 of a diameter to fit the two upper and the two lower bores of the mill are secured to the mill face by clamps or existing studs 16'. Since there would be interference, their neighboring sides are milled straight with no play in between. Beams 17' are placed to touch their horizontal faces and are pressed against each other by such means as threaded columns 18 with nuts or hydraulic jacks. Casters 19 are placed in slots milled in said beams and turning around eccentrics 20, the latter rotatably mounted in holes 21 in said beams and equidistant from the veritcal plane of symmetry of the mill. Both the top and bottom eccentrics 20 are rotated in symmetry to each other by worm gear drives 22 connecting both eccentrics of a beam together for symmetrical rotation. The boring spindle has the form of a cylinder 24 and is supported for rotation and/or axial sliding by said four casters. The symmetrically driven caster eccentrics assure that the spindle will always be in the plane of symmetry of the mill, while the center height is first adjusted by the eccentrics of the bottom casters, and then the top casters are lowered to assure spindle support without play.

Suitable boring or milling attachments are mounted on said spindle for removal or the metal and for precision finishing of the bore. These are well known and need not be illustrated here.

The narrow border areas against which the four clamps bear, of course remain not machined. But no accurate machining is required there since they are simply relief areas, and so any suitable portable equipment will do as long as the diameter of the bore is larger than the central precision bore affixed with the aid of the disclosed fixtures.

The embodiments of the invention in which an exclusive property or privilege is claimed are defined as follows:

1. In a multi-roll mill for rolling wide strips, a one-piece mill housing having a rigid beam facing each side of the strip, each beam having on its pressure side an arcuate section machined around the roll bite as an axis, an insert snugly seated in each of said arcuate sections, each of said inserts having arcuate channels machined on its inner surface parallel to said axis, roll-backing elements seated in said channels, each of said inserts being interchangeable in order to change the roll configuration of the mill, each of said inserts being axially divided into segments, each segment having at least one of said channels therein, each segment being individually fastened to its respective one of said arcuate beam sections by means operable from the front side of said mill for withdrawal and replacement.

2. A mill according to claim 1, wherein each of said inserts is axially divided into three segments for symmetrical roll configurations, the middle segment having two arcuate channels.

3. A mill according to claim 1 wherein means are provided for attaching roll-backing elements in said channels, said means being accessible for operation while said segments are outside the mill, whereby the segments can be mounted as a complete assembly.

4. A mill according to claim 1 wherein said segments have dovetail grooves machined in their channels, each groove serving to locate one backing element having a bearing portion machined to fit said dovetail groove.

5. A mill according to claim 1 wherein each segment of the insert is secured to the rigid beam at its front and rear ends, said ends being tapered and engaging a reverse tapered fixed clamp provided at the rear end, and a like removable clamp at the front end of the mill.

6. A mill according to claim 1, wherein individual pressure means are provided on either side of the pressure bearing interface between the inserts and the housing, each of said means being located opposite a roll-backing element and each capable of transmitting pressure against said roll-backing element at least sufficient to increase slightly the reduction by the workrolls at the spot opposite said backing element.

7. A mill according to claim 6, wherein each of said pressure means comprises a cluster of several small pressure elements, said clusters having their group pressure center located in the same spot as a single pressure element.

8. A mill according to claim 6, wherein said pressure elements are in the form of shallow cavities in the bottom of said inserts capable of serving as oil cylinders, flat pistons in said oil cylinders sealed against fluid leakage and connected to controllable fluid pressure means, the outside of said pistons contacting the opposite face to exert pressure thereon.

9. A mill according claim 6, wherein said pressure elements consist of pockets situated between the outside faces of said inserts and a superposed plate, and formed by oil-tight seams surrounding selected areas of the interface between said insert and said plate, said pockets being connected with controllable fluid pressure means by holes provided in said inserts.

10. The method of producing a flat metal strip by cold rolling comprising the steps of providing a multi-roll mill comprising a one-piece mill housing having a rigid beam facing each side of the strip, each beam having on its pressure side an arcuate section machined around the roll bite as an axis, an insert snugly seated in each of said arcuate sections, each of said inserts having arcuate channels machined on its inner surface parallel to said axis, roll-backing elements seated in said channels, each of said inserts being axially divided into segments, each segment having at least one of said channels therein, each segment being individually fastened to its respective one of said arcuate beam sections by means operable from the front of said mill, providing individual pressure means on either side of the pressure bearing interface between said inserts and said housing, locating each of said pressure means opposite a roll-backing element and each of said pressure means being capable of transmitting pressure against said roll backing element to increase slightly the reduction by the work rolls at a spot opposite said backing element, pressurizing said pressure means on at least one of said segments, at a pressure which is one-half of the maximum working pressure, and equal for all said roll-backing elements, and decreasing the pressure in individual ones of said pressure means which back a workroll in an area where it is overrolling the strip, while increasing the pressure at other roll-backing elements.

11. The method of producing a strip of even gauge by cold rolling which includes the steps of providing a multi-roll mill comprising a one-piece mill housing having a rigid beam facing each side of the strip, each beam having on its pressure side an arcuate section machined around the roll bite as an axis, an insert snugly seated in each of said arcuate sections, each of said inserts having arcuate channels machined on its inner surface parallel to said axis, roll-backing elements seated in said channels, each of said inserts being axially divided into segments, each segment having at least one of said channels therein, each segment being individually fastened to its respective one of said arcuate beam sections by means operable from the front of said mill, providing individual pressure means on either side of the pressure bearing interface between said inserts and said housing, locating each of said pressure means opposite a roll-backing element and each of said pressure means being capable of transmitting pressure against said roll backing element to increase slightly the reduction by the work rolls at a spot opposite said backing element, pressurizing said pressure means on at least one of said segments at a pressure which is one-half of the maximum working pressure, and equal for all of said roll-backing elements, and, while maintaining said pressure even for all said roll-backing elements, increasing said pressure when the strip is heavier than, and decreasing said pressure when the strip is lighter than, the prescribed thickness.

12. The method of producing a flat strip of even gauge by cold rolling which comprises the steps of providing a multi-roll mill comprising a one-piece mill housing having a rigid beam facing each side of the strip, each beam having on its pressure side an arcuate section machined around the roll bite as an axis, an insert snugly seated in each of said arcuate sections, each of said inserts having arcuate channels machined on its inner surface parallel to said axis, roll-backing elements seated in said channels, each of said inserts being axially divided into segments, each segment having at least one of said channels therein, each segment being individually fastened to its respective one of said arcuate beam sections by means operable from the front of said mill, providing individual pressure means on either side of the pressure bearing interface between said inserts and said housing, locating each of said pressure means opposite a roll-backing element and each of said pressure means being capable of transmitting pressure against said roll backing element to increase slightly the reduction by the work rolls at a spot opposite said backing element, pressurizing said pressure means on at least one of said segments, at a pressure which is one-half of the maximum working pressure and equal for all said roll-backing elements, and decreasing the pressure on some of said pressure means at roll-backing elements in an area where the strip is being over-rolled, while increasing the pressure at other roll-backing elements, and similarly, on at least one of the remaining segments, while maintaining said pressure even for all said roll-backing elements, increasing the pressure when the strip is heavier than, and decreasing said pressure when the strip is lighter than, the prescribed thickness.

13. The method of producing a flat strip of even gauge by cold rolling which comprises, the steps of providing a multi-roll mill comprising a one-piece mill housing having a rigid beam facing each side of the strip, each beam having on its pressure side an arcuate section machined around the roll bite as an axis, an insert snugly seated in each of said arcuate sections, each of said inserts having arcuate channels machined on its inner surface parallel to said axis, roll-backing elements seated in said channels, each of said inserts being axially divided into segments, each segment having at least one of said channels therein, each segment being individually fastened to its respective one of said arcuate beam sections by means operable from the front of said mill, providing individual pressure means on either side of the pressure bearing interface between said inserts and said housing, locating each of said pressure means opposite a roll-backing element and each of said pressure means being capable of transmitting pressure against said roll backing element to increase slightly the reduction by the work rolls at a spot opposite said backing element, pressurizing said preasure means on at least one of said segments, associated with one workroll and at least one segment associated with the other workroll at a pressure which is one-half of the maximum working pressure, and equal for all said roll-backing elements, and as to all segments associated with said other workroll, while maintaining said pressure even for all roll-backing elements associated with said other workroll, decreasing said pressure in individual ones of said pressure means which back said other workroll in an area where it is overrolling the strip, while increasing the pressure at other roll-backing elements in association with said other workroll, and as to all segments associated with said one workroll, while maintaining the pressure even for all said roll-backing elements associated with said one workroll, increasing the pressure when the strip is heavier than, and decreasing said pressure when the strip is lighter than, the prescribed thickness.

* * * * *